US010827259B2

(12) United States Patent
Fontana et al.

(10) Patent No.: US 10,827,259 B2
(45) Date of Patent: Nov. 3, 2020

(54) MICROPHONE ASSEMBLY HAVING A RECONFIGURABLE GEOMETRY

(71) Applicants: Huawei Technologies Co., Ltd., Shenzhen (CN); UNIVERSITY OF PARMA, Parma (IT)

(72) Inventors: Simone Fontana, Munich (DE); Angelo Farina, Parma (IT)

(73) Assignees: Huawei Technologies Co., Ltd., Shenzhen (CN); University of Parma, Parma (IT)

( * ) Notice: Subject to any disclaimer, the term of this patent is extended or adjusted under 35 U.S.C. 154(b) by 0 days.

(21) Appl. No.: 16/550,116

(22) Filed: Aug. 23, 2019

(65) Prior Publication Data

US 2019/0379969 A1 Dec. 12, 2019

Related U.S. Application Data

(63) Continuation of application No. PCT/EP2017/054395, filed on Feb. 24, 2017.

(51) Int. Cl.
*H04R 1/00* (2006.01)
*H04R 1/40* (2006.01)

(52) U.S. Cl.
CPC ..... *H04R 1/406* (2013.01); *H04R 1/005* (2013.01); *H04R 2201/003* (2013.01); *H04R 2201/023* (2013.01); *H04R 2201/405* (2013.01)

(58) Field of Classification Search
CPC . H04R 1/00; H04R 1/005; H04R 1/04; H04R 1/08; H04R 1/32; H04R 1/40;
(Continued)

(56) References Cited

U.S. PATENT DOCUMENTS 3,168,617 A * 2/1965 Richter ..... H01B 7/0838 174/117 FF
6,084,950 A * 7/2000 Pinault ..... H04M 3/51 379/442

(Continued)

FOREIGN PATENT DOCUMENTS

WO 2004107805 A1 12/2004
WO 2011042823 A1 4/2011
WO 2014079578 A1 5/2014

OTHER PUBLICATIONS

Lewis, "Technical Article Analog and Digital MEMS Microphone Design Considerations," Technical Article MS-2472, XP055406998, pp. 1-4, Analog Devices, Norwood, Massachusetts (Jan. 1, 2013).

(Continued)

*Primary Examiner* — Thang V Tran
(74) *Attorney, Agent, or Firm* — Leydig, Voit & Mayer, Ltd.

(57) ABSTRACT

The disclosure relates to a microphone assembly (100) for acquiring a plurality of audio signals, wherein the microphone assembly (100) has a reconfigurable geometry so that the microphone assembly (100) may be configured to be embedded in or attached to a body. The microphone assembly (100) comprises: a plurality of digital microphones (101*a-h*) configured to convert the sound signal impinging on each digital microphone into a corresponding digital electrical signal, a digital signal processing unit (102) comprising a serial digital communication interface (102*a*) and a processor (102*b*), and a connecting and mounting structure configured to provide a flexible electrical connection and a flexible mechanical arrangement for the plurality of digital microphones (101*a-h*).

12 Claims, 8 Drawing Sheets

(58) Field of Classification Search
CPC ..... H04R 1/406; H04R 9/08; H04R 11/04; H04R 19/04; H04R 2201/003; H04R 2201/023; H04R 2201/40; H04R 2201/401; H04R 2201/403; H04R 2201/405; H03R 3/005
See application file for complete search history.

(56) References Cited

U.S. PATENT DOCUMENTS

| | | | | |
|---|---|---|---|---|
| 6,225,563 | B1 * | 5/2001 | Poulsen | H01B 7/0018 174/117 FF |
| 9,191,741 | B1 | 11/2015 | Brusniak | |
| 9,307,326 | B2 | 4/2016 | Elko | |
| 2012/0182834 | A1 * | 7/2012 | Mullen | F41G 3/147 367/118 |
| 2012/0275272 | A1 * | 11/2012 | Mullen | F41G 3/147 367/118 |
| 2013/0096368 | A1 * | 4/2013 | Devroey | A61B 5/11 600/28 |
| 2013/0101136 | A1 | 4/2013 | McElveen | |
| 2013/0121505 | A1 | 5/2013 | Duraiswami et al. | |
| 2014/0270246 | A1 * | 9/2014 | Swanson | H04R 3/005 381/92 |
| 2016/0234966 | A1 * | 8/2016 | Li | H05K 7/20172 |
| 2017/0026728 | A1 | 1/2017 | Elko | |

OTHER PUBLICATIONS

Palla et al., "Wearable Speech Enhancement System based on MEMS Microphone Array for Pisabled people," 2015 10th International Conference on Design and Technology of Integrated Systems in Nanoscale Era (DTIS), Naples, Italy, Institute of Electrical and Electronics Engineers, New York, New York (Apr. 2015).

* cited by examiner

MICROPHONE ASSEMBLY HAVING A RECONFIGURABLE GEOMETRY

CROSS-REFERENCE TO RELATED APPLICATIONS

This application is a continuation of International Application No. PCT/EP2017/054395, filed on Feb. 24, 2017, the disclosure of which is hereby incorporated by reference in its entirety.

TECHNICAL FIELD

Embodiments of the present disclosure relate to audio engineering. More specifically, embodiments of the disclosure relates to a microphone assembly with a reconfigurable geometry for acquiring a plurality of audio signals.

BACKGROUND

The availability of inexpensive, small, and surface-mounted digital MicroElectroMechanical System (MEMS) microphone devices has enabled microphone arrays with a large number of microphones to be built in ways that would have been nearly impossible just a short time ago. In particular, a new type of MEMS microphones equipped with an I2S digital interface carrying full-bandwidth, high-dynamic, Pulse-Code Modulation (PCM) signals is inherently superior to currently popular digital MEMS microphones equipped with a digital Pulse-Density Modulation (PDM) interface. The latter has been widely employed in mobile devices such as smartphones, tablets, and etc.

The new I2S digital interface available only in the latest digital MEMS microphones offers significant advantages with regard to flexible cabling and mounting of microphones, allowing the possibility for building flexible microphone arrays unrestricted by contamination of the digital signals and very high clock rates. These contamination problems are inherent and unsolvable in the MEMS microphones with the PDM interface. Furthermore, the digital clock of an I2S interface is typically 48 kHz whilst the digital clock of a PDM microphone is typically several MHz. Thus, the digital signal transmitted via an I2S connection is much more robust and can travel longer distance without degradation.

While a MEMS microphone with a PDM interface is meant to be soldered directly on a Printed Circuit Board (PCB) on which a digital signal processing unit for receiving the microphone signal is also soldered, a MEMS microphone with an I2S interface can be placed quite far apart from another MEMS microphone with an I2S interface or a digital signal processing unit, allowing for new connectivity and wiring.

A number of designs and configurations for setting up a MEMS microphone array can be found in the literature: U.S. Pat. No. 9,307,326 discloses a MEMS microphone array mounted onto a foldable surface that could be bent to form various three-dimensional shapes. US20130101136 discloses a wearable microphone array apparatus on a garment as a directional audio system and as an assistive listening device. WO2014079578 discloses mounting a microphone array in combination with a control unit for receiving signals on a garment. A wearable MEMS microphone array with flexible flat cabling is disclosed in "Wearable speech enhancement system based on MEMS microphone array for disabled people," by A. Palla, L. Fanucci, R. Sannino and M. Settin, 2015 10th International Conference on Design & Technology of Integrated Systems in Nanoscale Era (DTIS), Naples, 2015. However, the designed microphone array merely consists of two microphone devices whose signals are processed by a trivial delay-and-sum adaptive beamforming algorithm. U.S. Pat. No. 9,191,741 discloses a group of microphone arrays with changeable spatial positions adapted to the frequency range to be recorded, but the spatial positions are pre-determined and fixed to a certain pattern.

Unfortunately, the previous works mentioned above have a critical problem: the prior art microphone arrays are all constrained to a pre-determined configuration or/and fixed positions, which fails to provide a user with freedom to choose where to place the microphones. The limitation on the arrangement of the MEMS microphones posed by the PDM interface results from the requirement of a regular geometry, and/or of a small distance between the microphones and the digital signal processing unit, and/or of soldering the microphones and the processing unit on the same Printed Circuit Board (PCB).

In light of the above, there is a need for an improved microphone assembly for acquiring a plurality of audio signals, allowing a flexible arrangement of microphones and a convenient placement of the microphones on a body.

SUMMARY

It is an object of the disclosure to provide an improved microphone assembly for acquiring a plurality of audio signals, which allows a flexible arrangement of microphones and a convenient placement of the microphones on a body.

The foregoing and other objects are achieved by the subject matter of the independent claims. Further implementation forms are apparent from the dependent claims, the description and the figures.

Generally, the disclosure relates to a microphone assembly with a reconfigurable geometry for acquiring a plurality of audio signals. More specifically, the present disclosure provides flexible microphone arrays employing digital MEMS microphones, and overcomes the limitations on distance and positions of the microphones posed by the Pulse-Density Modulation (PDM) interface, which is currently the most widely employed interface in digital MEMS microphones. A new generation of digital MEMS microphones is now available and provides a more robust and flexible digital I2S interface carrying ready-to-be-processed Pulse-Code Modulation (PCM) digital signals. The connection between microphones and a digital signal processing unit can be made through a rigid or flexible Printed Circuit Board (PCB), low-cost and robust flat cables, as well as inexpensive and easy-to-assemble pressure-crimped connectors.

The disclosure provides several advantages based on these new digital MEMS microphones. The main advantage of employing the flexible solution is the much larger freedom in choosing where to place the microphones, not being constrained by the need of a regular geometry and/or a small distance between the microphones and the digital signal processing unit, or by the requirement of soldering the microphones and the processor on the same Printed Circuit Board (PCB). This allows building microphone arrays with an unconstrained geometry which can be changed even during the operation of the microphone array. This makes it easier to place the microphones in or on wearable items such as clothes, hats, umbrellas, or backpacks, or to enable the microphone array to self-optimize its configuration on the basis of a real-time analysis of the acoustical field, e.g., by moving the microphones to positions where they can provide optimal signal capture.

More specifically, a first aspect of the disclosure relates to a microphone assembly for acquiring a plurality of audio signals, wherein the microphone assembly has a reconfigurable geometry so that the microphone assembly may be configured to be embedded in or attached to a body. The microphone assembly comprises: a plurality of digital microphones configured to convert the sound signal impinging on each digital microphone into a corresponding digital electrical signal, in particular a Pulse-Code-Modulation (PCM) or a Pulse-Density-Modulation (PDM) digital serial electrical signal; a digital signal processing unit comprising a serial digital communication interface and a processor, wherein the serial digital communication interface is configured to receive the digital electrical signals provided by the plurality of digital microphones, and wherein the processor is configured to store, transmit, and/or process the digital electrical signals provided by the plurality of digital microphones; and a connecting and mounting structure configured to provide a flexible electrical connection and a flexible mechanical arrangement for the plurality of digital microphones, wherein the connecting and mounting structure comprises a plurality of wired connections configured to connect the plurality of digital microphones with the serial digital communication interface in such a way that at least one of the plurality of digital microphones is moveable relative to the others.

Thus, an improved microphone assembly is provided, allowing a flexible arrangement of microphones and a convenient placement of the microphones on a body. The body may be rigid or flexible.

In a first implementation form of the microphone assembly according to the first aspect as such, the plurality of wired connections comprise flexible flat cables connecting the digital microphones to the digital signal processing unit. Such cables can be particularly convenient for placement of the microphone assembly in a wearable item.

In a second implementation form of the microphone assembly according to the first aspect as such or the first implementation form thereof, the plurality of wired connections comprise the following wires: a Clock wire for carrying clock signals to the digital microphones; a Word-Select wire for carrying to the digital microphones a signal specifying the selection of the Left-Right channel of the digital interface; a serial-data wire for carrying PCM or PDM digital serial data from the digital microphones to the digital signal processing unit; a GND wire for connecting the ground of the digital microphones to the ground of the digital signal processing unit; and a VCC wire for providing the voltage required to power the electronics embedded inside the digital microphones; wherein each of the one or more wires is connected to two or more or each of the plurality of digital microphones. The microphone assembly can thus be particularly convenient.

In a third implementation form of the microphone assembly according to the second implementation form of the first aspect, the plurality of wired connections further comprise: a first digital buffer configured to buffer the Clock signals for the plurality of digital microphones; a second digital buffer configured to buffer the Word-Select signals for the plurality of digital microphones; a plurality of resistors configured to terminate properly the serial-data wires. The microphone assembly can thus be particularly convenient.

In a fourth implementation form of the microphone assembly according to the first aspect as such, the digital signal processing unit comprises one or more of the following: a Digital Signal Processor (DSP) chip, a microcontroller, a Central Processing Unit (CPU) and/or a Field Programmable Gate Array (FPGA) chip. The microphone assembly can thus be particularly convenient.

In a fifth implementation form of the microphone assembly according to the first aspect as such, the connecting and mounting structure comprises a plurality of enclosures, each enclosure encasing a rigid Printed Circuit Board (PCB), wherein one or optionally two microphones of the plurality of digital microphones are soldered on the rigid Printed Circuit Board (PCB) and connected to one of the plurality of wired connections. The microphone assembly can thus be particularly convenient.

In a sixth implementation form of the microphone assembly according to the fifth implementation form of the first aspect, the connecting and mounting structure comprises a plurality of fixing devices for fixing the plurality of enclosures on a surface of the rigid or flexible body where the digital microphone array is installed. The microphone assembly can thus be easily fixed to a surface.

In a seventh implementation form of the microphone assembly according to the sixth implementation form of the first aspect, the plurality of fixing devices comprise one or more suction cups, clips, pins, zips, buttons, adhesive pads, crocodile jaws, and/or LEGO™ compatible bricks.

In an eighth implementation form of the microphone assembly according to the first aspect as such or any one of the first to seventh implementation form thereof, the digital signal processing unit is configured to determine the position of at least one microphone of the plurality of digital microphones on the basis of the electrical signals provided by the plurality of digital microphones. The microphone assembly can thus be particularly convenient.

In a ninth implementation form of the microphone assembly according to the first aspect as such or any one of the first to eighth implementation form thereof, the microphone assembly further comprises one or more motors, wherein each motor is configured to move at least one of the plurality of digital microphones. The microphone assembly can thus be particularly convenient.

In a tenth implementation form of the microphone assembly according to the first aspect as such or any one of the first to ninth implementation form thereof, the processor of the digital signal processing unit is configured, for each or for at least one of the plurality of digital microphones, to estimate a target position of the respective digital microphone on the basis of the signals provided by the plurality of digital microphones. The microphone assembly can thus be particularly convenient.

In an eleventh implementation form of the microphone assembly according to the tenth implementation form of the first aspect, the microphone assembly further comprises a controller configured to control the positions of one or more of the digital microphones and wherein the processor is configured to send information about the target positions via the serial digital communication interface to the controller for moving the one or more digital microphones to their respective target positions. The microphone assembly can thus be particularly convenient.

In a twelfth implementation form of the microphone assembly according to the first aspect as such or any one of the first to eleventh implementation form thereof, the processor of the digital signal processing unit is configured to compute a set of digital filters and to process the electrical signals provided by the plurality of digital microphones using the set of digital filters, wherein the set of digital filters can be adaptive and time-variant according to changes in an acoustical field, and/or changes of positions of the plurality of digital microphones. The microphone assembly can thus be particularly convenient.

In a thirteenth implementation form of the microphone assembly according to the twelfth implementation form of the first aspect, the digital signal processing unit is configured to compute the set of digital filters on the basis of an approximate matrix inversion scheme, so as to generate one or more processed microphone signals with improved signal-to-noise ratio and better directivity pattern in comparison with raw microphone signals provided by the digital microphones. The microphone assembly can thus be particularly convenient.

In prior art works, positions of microphones in a microphone array have to be precisely controlled, either according to theoretical formulations or according to heuristic optimization of the shape of the array. In this fashion, a controller of the microphone array always "knows" where the microphones are, and the way in which the signals are processed relies on such knowledge.

In contrast, embodiments of the present disclosure allow removing these constraints. As will be illustrated below, no rigid connection exists between the microphones in a flexible microphone assembly according to embodiments of the disclosure. Therefore, each microphone can be freely placed to any position considered optimal for a particular usage of the microphone assembly. Flexibility also means flexible cabling and mounting provided by embodiments of the disclosure, which enables the implementation of microphones on a surface of any body, including a human body.

A digital MicroElectroMechanical System (MEMS) microphone is a type of microphone, which provides substantial advantages in terms of cost-performance ratio and long-term stability. However, the digital MEMS microphones widely employed in smartphones or other mobile devices nowadays are rigid with regard to their mechanical mounting and electrical interfacing, which may be due to the following reasons: the contact points are small areas meant for surface-mount soldering over a Printed Circuit Board (PCB); the acoustical port is typically designed to interface with the external world by means of a hole in the PCB; the device is so small that it may be impossible to solder a multicore cable to its contacts; the electrical PDM interface is designed to operate only over very short distance, with the signals travelling inside a single PCB over which both the microphone (transmitter) and the DSP (receiver) are soldered; and no provision is made for sharing a number of wires among a large number of microphones, making the cabling redundant and unnecessarily complex.

Recently, a novel type of digital MEMS microphones, equipped with an advanced and efficient digital audio interface I2S, has been made available. Thus, it is possible to build reliable microphone arrays with flexible cabling and mounting by employing proper wiring and auxiliary electronics. The obtained flexibility can be exploited in various ways. The microphones can be placed, for instance, outside or inside a variety of objects and bodies, including cloths, hats and other parts of personal fittings, which is useful for secretly recording. Alternatively, the microphones can also be placed onto objects which are allowed to freely change their position in space, even during the operation of the microphone assembly. In such case, the microphones can be placed on rotating or movable objects so that the positions of the microphones can be actively controlled, which can optimize the overall geometry of the assembly for capturing the sound of interest. Instead of controlling actively the positions of the microphones, an intelligent processing unit for detecting the location of each microphone can be employed when a microphone assembly of the "passive" type is used.

The following improvements can be achieved by embodiments of the disclosure: reliable electrical interfacing for single-cable (stripe) or multiple-cables configurations; practical and safe casing and fixing systems; advanced beamforming algorithms which do not require a regular or prefixed geometry of the assembly; "adaptive" processing strategies, capable of changing the processing filters whenever the geometry of the assembly changes; "intelligent" signal processing for understanding the microphone positions and/or finding the optimal positions to which the microphones can be moved. The improvements in hardware will be demonstrated in the following embodiments of the disclosure while examples of suitable algorithms for processing digital signals from microphones can be found in WO2011042823.

BRIEF DESCRIPTION OF THE DRAWINGS

Further embodiments of the disclosure will be described with respect to the following figures, wherein.

In the figures, identical reference signs will be used for identical or functionally equivalent features.

DETAILED DESCRIPTION OF THE EMBODIMENTS

In the following description, reference is made to the accompanying drawings, which form part of the disclosure, and in which are shown, by way of illustration, specific aspects in which the present disclosure may be placed. It will be appreciated that other aspects may be utilized and structural or logical changes may be made without departing from the scope of the present disclosure. The following detailed description, therefore, is not to be taken in a limiting sense, as the scope of the present disclosure is defined by the appended claims.

For instance, it will be appreciated that a disclosure in connection with a described method may also hold true for a corresponding device or system configured to perform the method and vice versa. For example, if a specific method step is described, a corresponding device may include a unit to perform the described method step, even if such unit is not explicitly described or illustrated in the figures.

Moreover, in the following detailed description as well as in the claims embodiments with different functional blocks or processing units are described, which are connected with each other or exchange signals. It will be appreciated that the present disclosure covers embodiments as well, which include additional functional blocks or processing units that are arranged between the functional blocks or processing units of the embodiments described below.

Finally, it is understood that the features of the various exemplary aspects described herein may be combined with each other, unless specifically noted otherwise.

Figure 1:
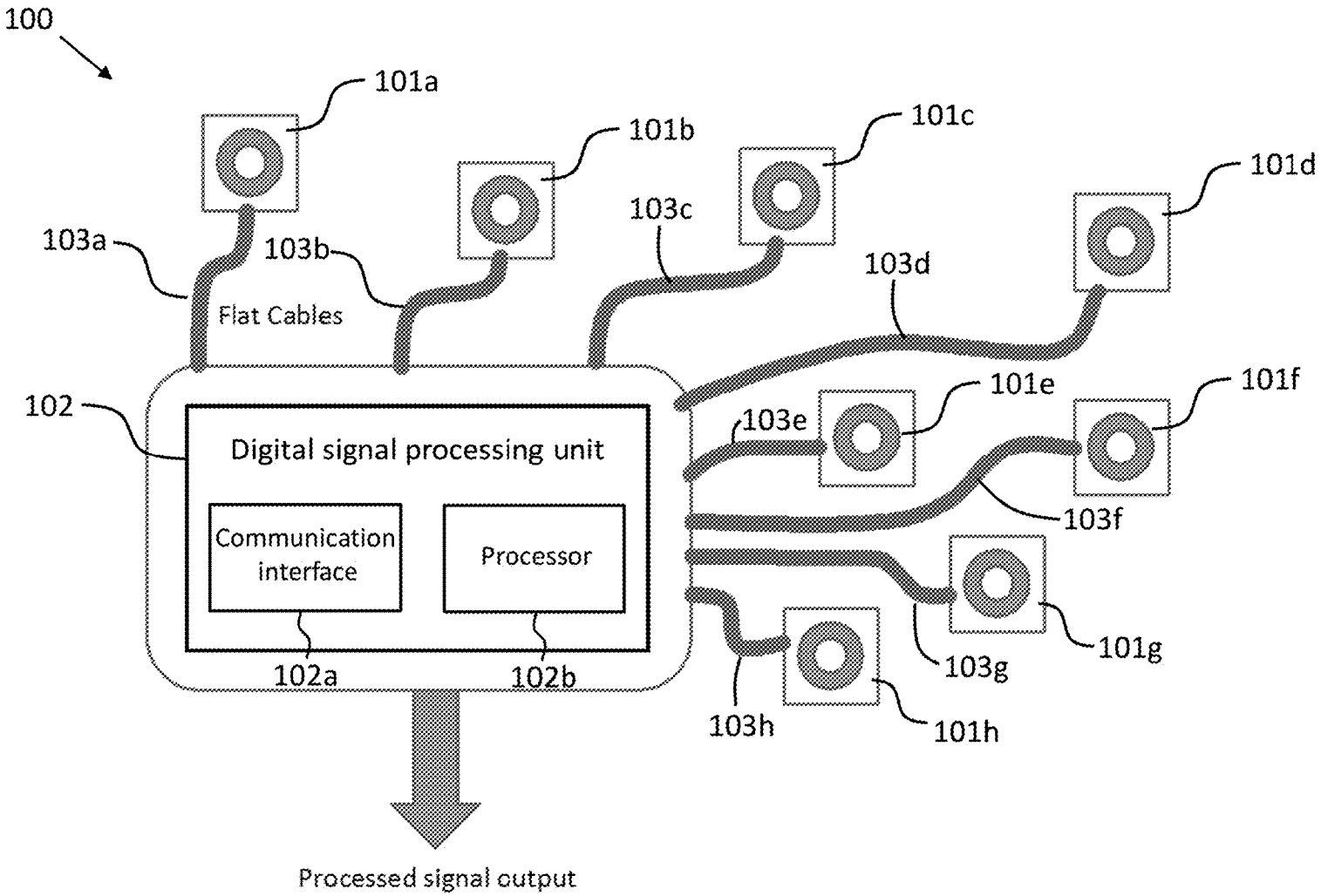
FIG. 1 shows a schematic diagram of a flexible microphone assembly according to an embodiment.

FIG. 1 shows an embodiment of a flexible microphone assembly 100 comprising a plurality of digital MEMS microphones 101*a-h* (e.g., with an I2S serial data interface). The microphone assembly 100 has no pre-defined geometry and it can operate, with variable acoustical performances, no matter how the positions of the microphones 101*a-h* are changed.

In the example of an embodiment in FIG. 1, the flexible microphone assembly 100 comprises eight digital MEMS microphones 101*a-h* and a digital signal processing unit 102. Each of the digital MEMS microphones 101*a-h* is connected to the digital signal processing unit 102 through a flexible flat cable 103*a-h*. Thus, each of the digital MEMS microphones 101*a-h* can be freely placed at any position, e.g., a position that is considered optimal for the acoustical performance of the microphone array.

In an embodiment, the digital signal processing unit 102 can be a Digital Signal Processor (DSP) chip, a microcontroller, a Central Processing Unit (CPU) and/or a Field Programmable Gate Array (FPGA) chip.

The plurality of digital MEMS microphones 101*a-h* are configured to convert the sound signal impinging on each microphone 101*a-h* into a corresponding digital electrical signal, in particular a Pulse-Code-Modulation (PCM) or a Pulse-Density-Modulation (PDM) digital serial electrical signal. The digital signal processing unit 102 comprises a serial digital communication interface 102*a* (e.g., an I2S interface) and a processor 102*b*, wherein the serial digital communication interface 102*a* is configured to receive the electrical signals provided by the plurality of digital MEMS microphones 101*a-h*. The processor 102*b* is configured to store, transmit, and/or process the digital electrical signals provided by the plurality of digital MEMS microphones 101*a-h*. As will be described in more detail below, the flexible flat cables 103*a-h* are part of a connecting and mounting structure configured to provide a flexible electrical connection and a flexible mechanical arrangement for the plurality of digital MEMS microphones 101*a-h*, wherein the connecting and mounting structure comprises a plurality of wired connections configured to connect the plurality of digital MEMS microphones 101*a-h* with the serial digital communication interface 102*a* in such a way that at least one of the plurality of digital MEMS microphones 101*a-h* is moveable relative to the others.

In an embodiment, the connecting and mounting structure comprises a plurality of enclosures, each enclosure encasing a rigid Printed Circuit Board (PCB), wherein one or optionally two microphones of the plurality of digital MEMS microphones 101*a-h* are soldered on the rigid Printed PCB and connected to one of the plurality of wired connections.

In an embodiment, the connecting and mounting structure comprises a plurality of fixing devices for fixing the plurality of enclosures on a surface of the rigid or flexible body where the microphone array is installed. In an embodiment, the plurality of fixing devices comprise suction cups, clips, pins, zips, buttons, adhesive pads, crocodile jaws, and/or LEGO™ compatible "bricks".

In an embodiment, the processor 102*b* of the digital signal processing unit 102 is configured to compute a set of digital filters and to process the electrical signals provided by the plurality of digital MEMS microphones 10*l* a-h using the set of digital filters, wherein the set of digital filters can be adaptive and time-variant according to changes in an acoustical field, and/or changes of positions of the plurality of microphones 101*a-h*.

In an embodiment, the digital signal processing unit 102 is configured to compute the set of digital filters on the basis of an approximate matrix inversion scheme, so as to generate one or more processed microphone signals with improved signal-to-noise ratio and better directivity pattern in comparison with raw microphone signals provided by the microphones 101*a-h*, as disclosed in WO2011042823 (already referred to above).

Figure 2:
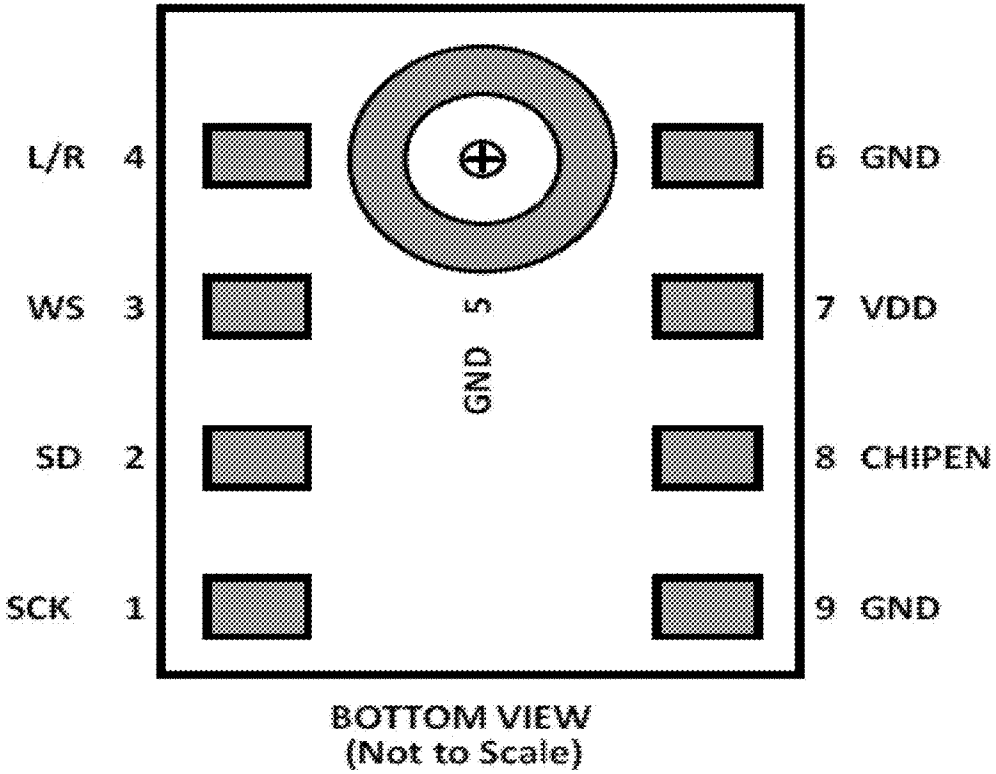
FIG. 2 shows a schematic diagram illustrating a typical pinout of a digital MEMS microphone with an I2S interface for a microphone assembly according to an embodiment.

FIG. 2 schematically illustrates an example of a pinout of a digital MEMS microphone 101*a-h* (e.g., with a digital I2S interface) of the microphone assembly 100 according to an embodiment. The name and function of each pin are explained in the following:

Pin 1 is called SCK with a function of Serial-Data Clock for the I2S Interface.

Pin 2 is called SD with a function of Serial-Data Output for the I2S Interface. This pin is tri-stated when it is not actively driving the appropriate output channel. The SD trace can comprise a 100 kΩ pulldown resistor to discharge the line during the time when all microphones 101*a-h* on the bus have tri-stated their outputs.

Pin 3 is called WS with a function of Serial Data-Word Select for the I2S Interface.

Pin 4 is called L/R and provides a function for Left/Right Channel Select. When it is set low, the microphone 101*a-h* outputs the signal in the left channel of the I2S frame. When it is set high, the microphone 101*a-h* outputs the signal in the right channel of the I2S frame.

Pins 5, 6 and 9 are called GND, and they are connected to the ground on the Printed Circuit Board (PCB).

Pin 7 is called VDD and is connected to the power with 1.8 V to 3.3 V. This VDD pin should be decoupled to pin 6 with a 0.1 μF capacitor.

Pin 8 is called CHIPEN and it can enable the microphone 101*a-h*. When pin 8 is set low (ground), the microphone 101*a-h* can be disabled and put in a power-down mode. When pin 8 is set high (VDD), the microphone 101*a-h* can thus be enabled.

In an embodiment, the acoustical port of the digital MEMS microphone 101*a-h* is located in the center of pin 5, which is meant to be soldered on the Printed Circuit Board (PCB). A central hole with this circular pin enables a sound to come into the microphone by passing through the Printed Circuit Board (PCB) itself.

Generally, each of the digital MEMS microphones 101*a-h* only needs five wires for connecting to the digital signal processing unit 102, as pin 4 (L/R) and pin 8 (CHIPEN) can be configured locally. According to an embodiment two of the digital MEMS microphones 101*a-h* can share the same five wires, as the Serial-Data output of the I2S interface allows two "sources" to be wired on the same cable. They can talk respectively according to the status of the WS line. In an embodiment, one of the two microphones can be configured as "left" and the other as "right". When more than two microphones are employed, the minimum number of the required wires will increase, but a number of wires can be shared among the digital MEMS microphones 101*a-h*, as seen in FIG. 3.

Figure 3:
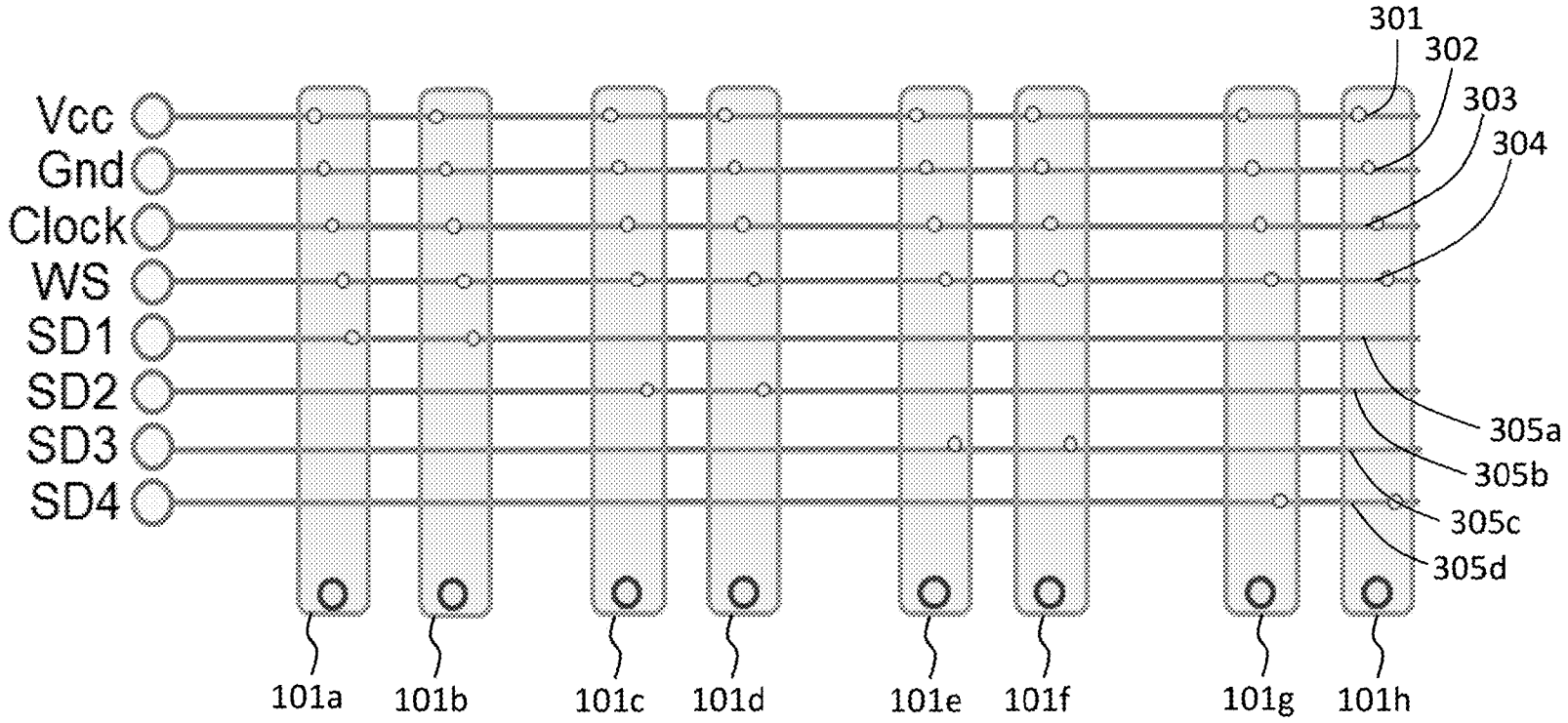
FIG. 3 shows a schematic diagram of a "stripe array" of digital microphones along a single flat cable of a microphone assembly according to an embodiment.

FIG. 3 illustrates an embodiment of the microphone assembly 100 with eight digital MEMS microphones 101*a-h* forming a stripe array along a single flat cable. This embodiment refers to the case in which all the eight digital MEMS microphones 10*l* a-h are "daisy-chained" on individual small PCBs and all are wired on a single, long flat cable with only eight wires.

As can be seen in FIG. 3, all of these eight digital MEMS microphones 101*a-h* can be connected to the same VCC 301, GND 302, Clock 303, Word-Select 304 wires, and each pair of the microphones 101*a-h* can share a Serial-Data wire 305. Therefore, eight wires in total are required for wiring eight digital MEMS microphones 101*a-h* together. To increase flexibility in the way each digital MEMS microphone 101*a-h* can be connected to its own individual flat cable 103*a-h*, the microphone assembly 100 can be arranged in a different schematic, which is depicted in FIG. 4.

Figure 4:
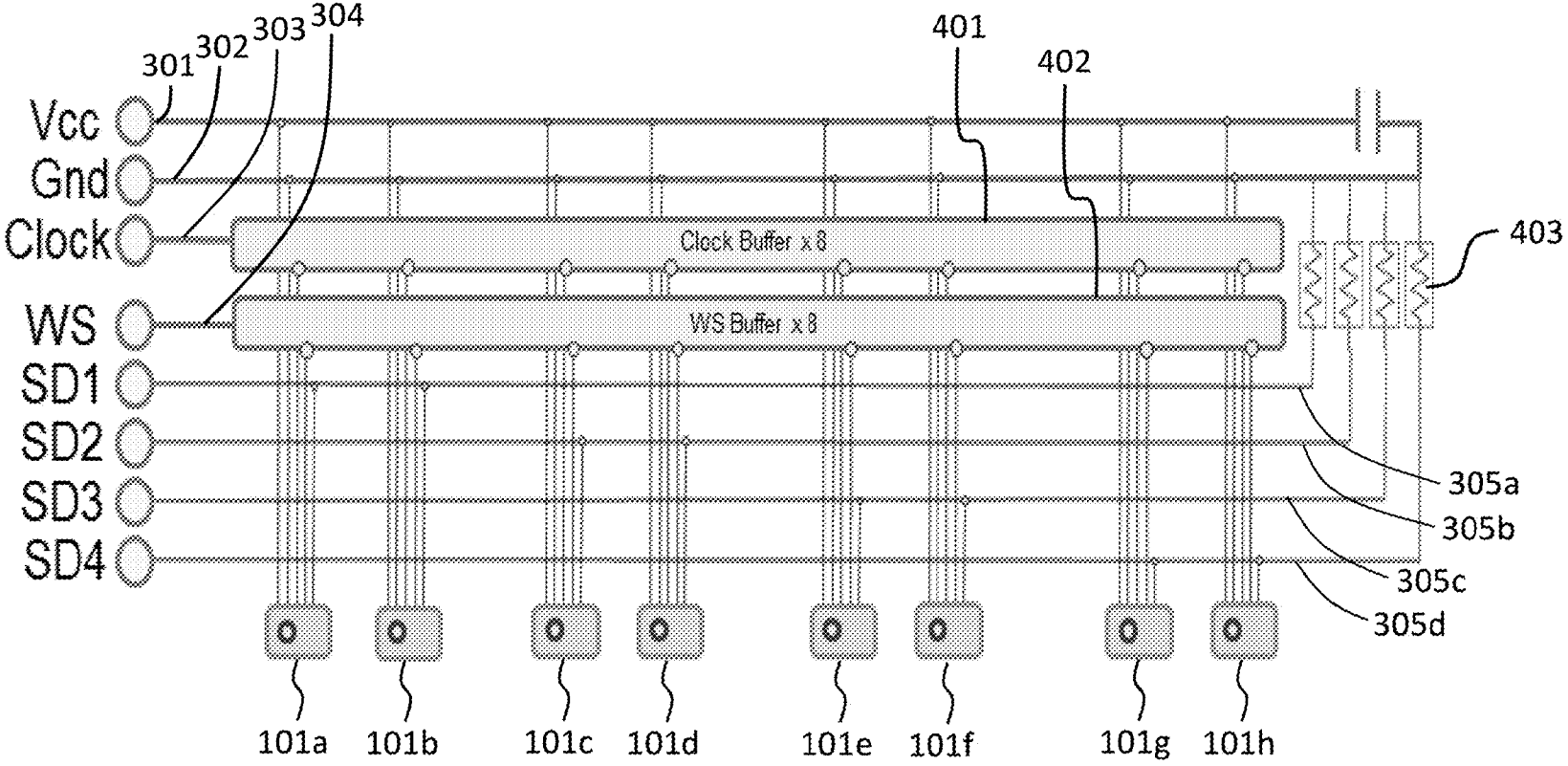
FIG. 4 shows a schematic diagram of a "chicken horse array" of digital microphones of a microphone assembly according to an embodiment.

FIG. 4 shows a schematic diagram of the microphone assembly 100 according to an embodiment, wherein the microphone assembly 100 comprises eight digital MEMS microphones 101*a-h* and forms a "chicken horse array" and wherein only 5 wires are used to connect with an end of the flat cable 103*a-h* of each digital MEMS microphone 101*a-h*. In this case, before the wires for individual microphones 101*a-h* are separated, it is advisable to buffer the Word-Select and Clock signals by means of a logic buffer 401, 402, such as the SN74HC541 8-channel, low-power logic buffer. The digital MEMS microphones 10*l* a-h are thus be provided with "clean" digital clock signals, avoiding artifacts caused by echoes. The echoes can occur if the split-out of the clock signals to several cables is done by simply wiring the cables together.

For the same reason, the Serial-Data wires 305*a-d* should be terminated properly: according to an embodiment four high-impedance resistors 403, e.g., 100*k* Ohm resistors, can be employed to terminate the Serial-Data lines 305*a-d* close to the split-out, so that the data transmitted by the two microphones 101*a-h* of each pair can remain clean when arriving at the digital signal processing unit 102 of the microphone assembly 100.

With the flexible electrical connection and mechanical arrangement for the digital MEMS microphones 101*a-h* shown in the above embodiment, a flexible microphone assembly is provided in which the digital MEMS microphones 101*a-h* can be individually placed in freely chosen positions.

Figure 5:
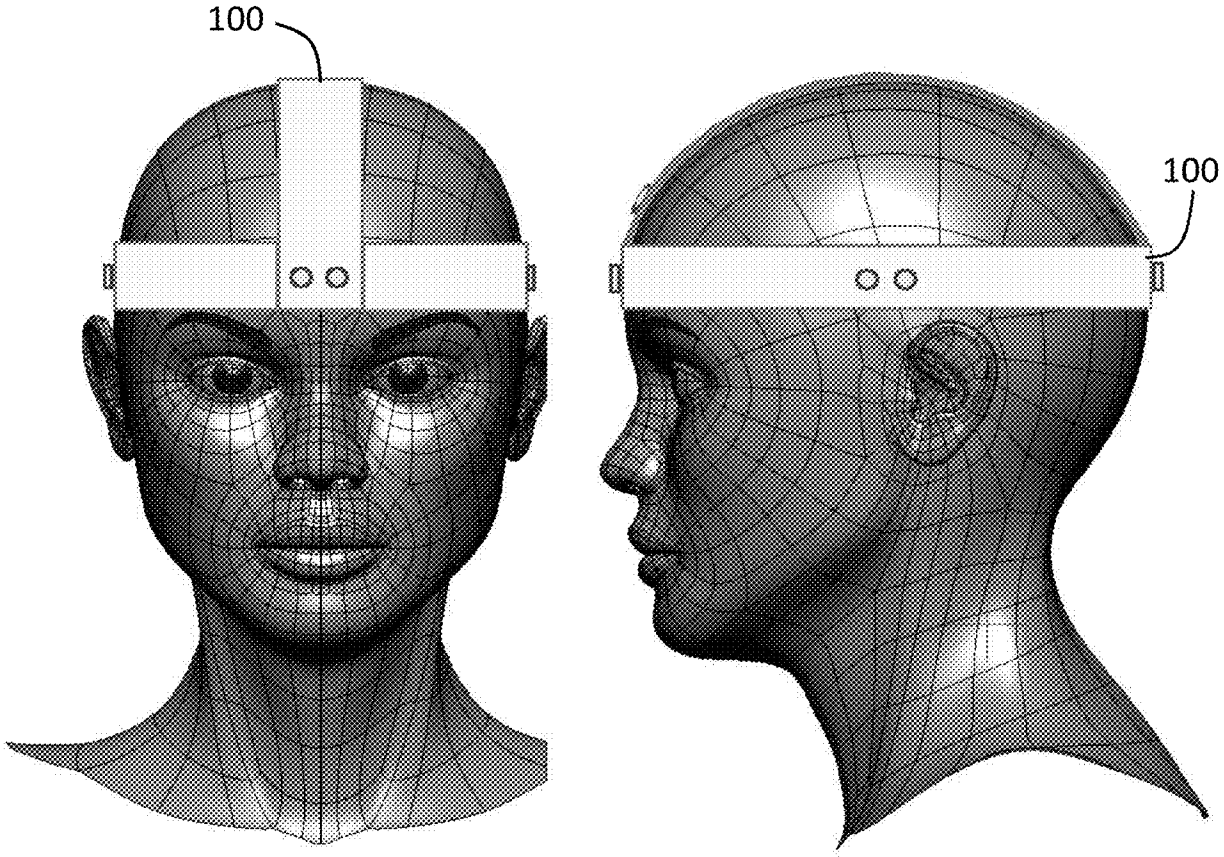
FIG. 5 shows an example of mounting a flexible microphone assembly over a human head according to an embodiment.

FIG. 5 shows a first example of how the flexible microphone assembly 100 can be used, wherein the flexible microphone assembly 100 is mounted over a human head according to an embodiment.

Figure 6:
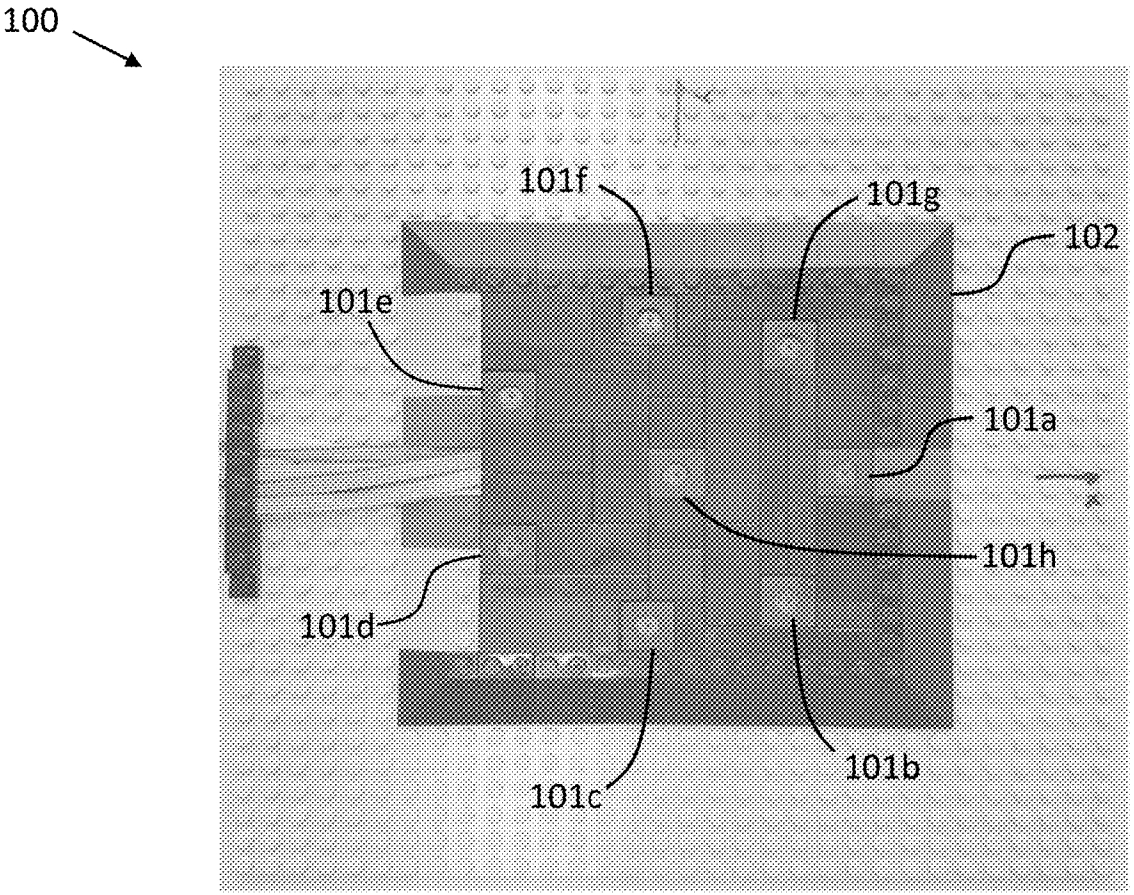
FIG. 6 shows an example of mounting a table-top planar microphone assembly on a LEGO™ compatible mounting system according to an embodiment.

FIG. 6 shows a second example of how the flexible microphone assembly 100 can be used, wherein a table-top planar microphone array is mounted on a LEGO™ compatible mounting system according to an embodiment.

As can be seen in FIG. 6, the casing and mounting systems mimic Lego™ bricks. This enables the digital MEMS microphones 101*a-h* to be incorporated in an infinite number of possible Lego™ constructions. The compatibility with LEGO™ bricks allows for construction of microphone assemblies in any shape. Lego Technic™ components can be used for building structures with movable parts.

Figure 7:
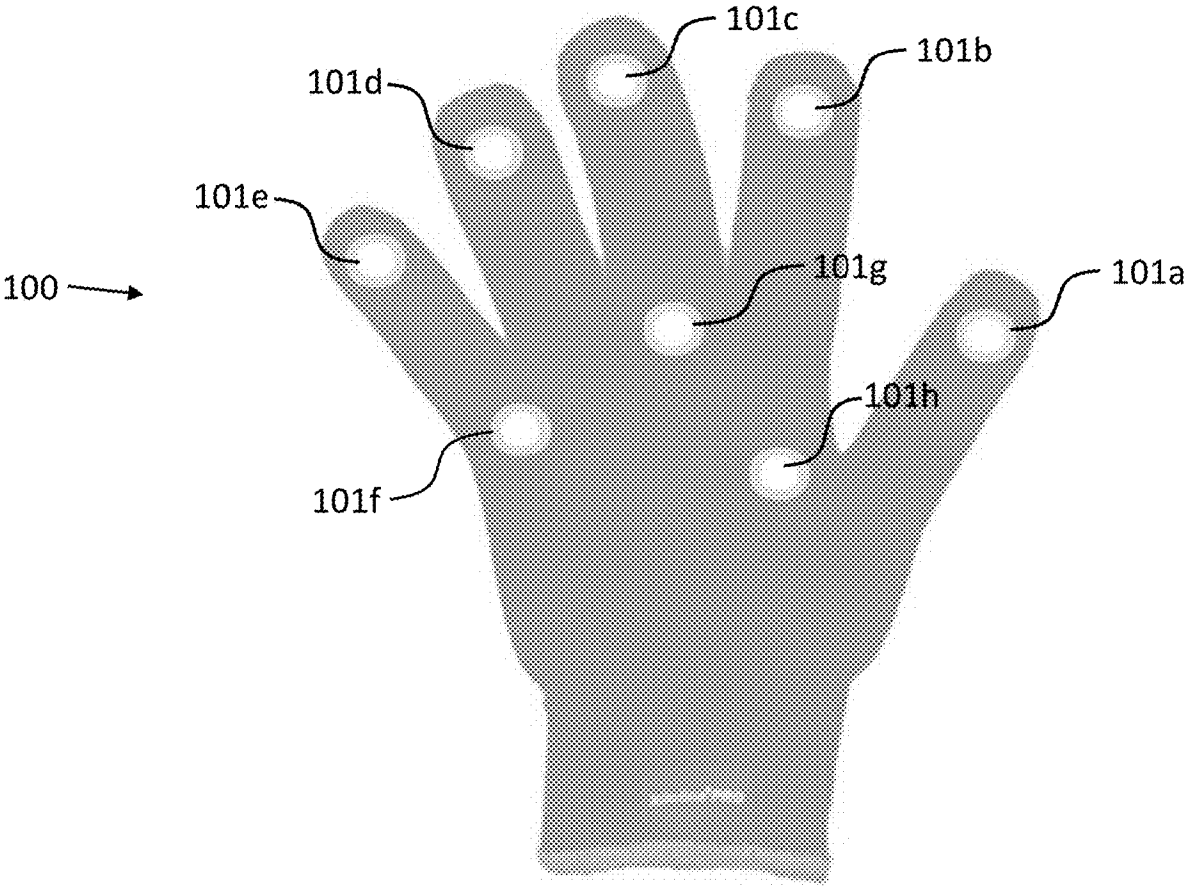
FIG. 7 shows an example of a "passive" microphone assembly according to an embodiment.

FIG. 7 shows a third example of how the flexible microphone assembly 100 can be used, wherein the microphone assembly 100 is attached to a glove according to an embodiment. The microphone assembly 100 of FIG. 7 comprises several (e.g., eight) digital MEMS microphones 10*l* a-h and a user can change the positions of the digital MEMS microphones 101*a-h* at will by simply moving the fingers.

Figure 8:
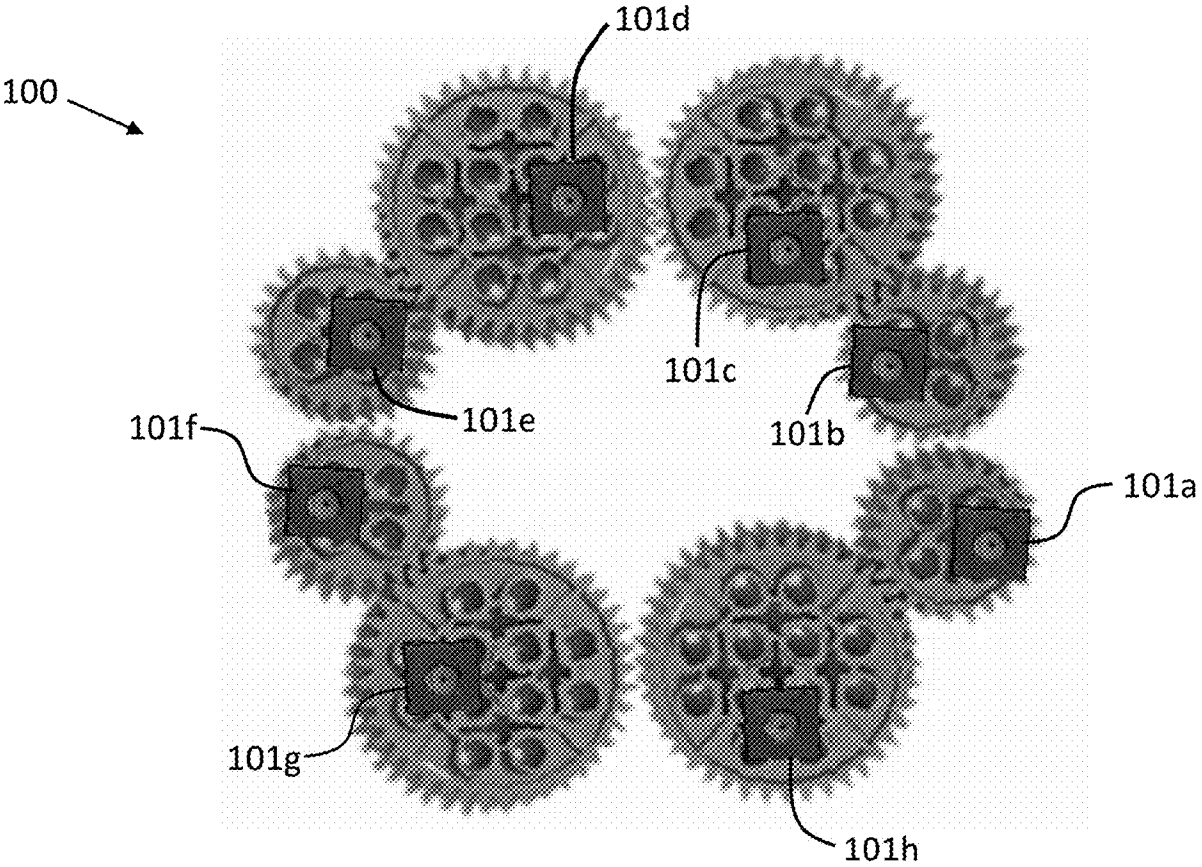
FIG. 8 shows an example of an "active" microphone assembly according to an embodiment.

FIG. 8 shows a fourth example of how the flexible microphone assembly 100 can be used. In the example, each microphone 101*a-h* of the microphone assembly 100 is placed on a rotating disk according to an embodiment. The rotating disks on which the digital MEMS microphones 101*a-h* are placed can form a robotized system under control of a digital microcontroller.

In an embodiment, the digital signal processing unit 102 can be configured to determine the previously unknown position of at least one microphone of the digital MEMS microphones 101*a-h* on the basis of the digital serial electrical signals provided by the digital MEMS microphones 101*a-h*. Furthermore, the digital signal processing unit 102 can, for each or for at least one of the digital MEMS microphones 101*a-h*, estimate a target position of the respective microphone 101*a-h* on the basis of the digital serial electrical signals provided by the digital MEMS microphones 101*a-h*.

The digital signal processing unit 102 can actively change the positions of the digital MEMS microphones 101*a-h* by instructing the digital microcontroller to move the microphones 101*a-h* into the target positions determined above. The target positions may be optimal positions to which the digital MEMS microphones 101*a-h* should be moved for improving the acoustical performance of the microphone array.

In an embodiment, the microphone assembly 100 further comprises one or more motors, wherein each motor is configured to move at least one of the plurality of digital MEMS microphones 101*a-h* to its target or optimal position.

While a particular feature or aspect of the disclosure may have been disclosed with respect to only one of several implementations or embodiments, such feature or aspect may be combined with one or more other features or aspects of the other implementations or embodiments as may be desired and advantageous for any given or particular application. Furthermore, to the extent that the terms "include", "have", "with", or other variants thereof are used in either the detailed description or the claims, such terms are intended to be inclusive in a manner similar to the term "comprise". Also, the terms "exemplary", "for example" and "e.g." are merely meant as an example, rather than the best or optimal. The terms "coupled" and "connected", along with derivatives may have been used. It should be understood that these terms may have been used to indicate that two elements cooperate or interact with each other regardless whether they are in direct physical or electrical contact, or they are not in direct contact with each other.

While specific aspects have been illustrated and described herein, it will be appreciated by those of ordinary skill in the art that a variety of alternate and/or equivalent implementations may be substituted for the specific aspects shown and described without departing from the scope of the present disclosure. This application is intended to cover any adaptations or variations of the specific aspects discussed herein.

Although the elements in the following claims are recited in a particular sequence with corresponding labeling, unless the claim recitations otherwise imply a particular sequence for implementing some or all of those elements, those elements are not necessarily intended to be limited to being implemented in that particular sequence.

Many alternatives, modifications, and variations will be apparent to those skilled in the art in light of the above teachings. Of course, those skilled in the art readily recognize that there are numerous applications of the disclosure beyond those described herein. While the present disclosure has been described with reference to one or more particular embodiments, those skilled in the art recognize that many changes may be made thereto without departing from the scope of the present disclosure. It is therefore to be understood that within the scope of the appended claims and their equivalents, the disclosure may be practiced otherwise than as specifically described herein.

What is claimed is:

1. A microphone assembly for acquiring a plurality of audio signals, the microphone assembly having a reconfigurable geometry so that the microphone assembly may be configured to be embedded in or attached to a body, the microphone assembly comprising:

a plurality of digital microphones configured to convert a sound signal impinging on each of the digital microphones into a corresponding digital electrical signal, wherein the digital electrical signal is a Pulse-Code-Modulation (PCM) or a Pulse-Density-Modulation (PDM) digital serial electrical signal;

a digital signal processor comprising a serial digital communication interface and a processor, wherein the serial digital communication interface is configured to receive the digital electrical signals provided by the plurality of digital microphones, and wherein the processor is configured to store, transmit, and/or process the digital electrical signals provided by the plurality of digital microphones; and a connecting and mounting structure configured to provide a flexible electrical connection and a flexible mechanical arrangement for the plurality of digital microphones, wherein the connecting and mounting structure comprises a plurality of wired connections configured to connect the plurality of digital microphones with the serial digital communication interface in such a way that at least one of the plurality of digital microphones is moveable relative to other digital microphones of the plurality of digital microphones, wherein the plurality of wired connections comprise:

a VCC wire for providing the voltage required to power electronics embedded inside the plurality of digital microphones;

a GND wire for connecting the ground of the plurality of digital microphones to the ground of the digital signal processor;

a Clock wire for carrying clock signals to the plurality of digital microphones;

a Word-Select wire for carrying to the plurality of digital microphones a signal specifying a selection of a Left-Right channel of the serial digital communication interface; and a serial-data wire for carrying PCM or PDM digital serial data from the plurality of digital microphones to the digital signal processor;

wherein each of the plurality of wires is connected to two or more of the plurality of digital microphones, and wherein the plurality of wired connections further comprise:

a first digital buffer configured to buffer the clock signals for the plurality of digital microphones;

a second digital buffer configured to buffer the word-select signals for the plurality of digital microphones; and a plurality of resistors configured to terminate the serial-data wire.

2. The microphone assembly of claim 1, wherein the plurality of wired connections comprise flexible flat cables connecting the digital microphones to the digital signal processor.

3. The microphone assembly of claim 1, wherein the digital signal processor comprises one or more of: a Digital Signal Processor (DSP) chip, a microcontroller, a Central Processing Unit (CPU) and/or a Field Programmable Gate Array (FPGA) chip.

4. The microphone assembly of claim 1, wherein the microphone assembly further comprises one or more motors, wherein each motor is configured to move at least one of the plurality of digital microphones.

5. The microphone assembly of claim 1, wherein the processor of the digital signal processor is configured for at least one of the plurality of digital microphones to estimate a target position of a respective digital microphone on the basis of the signals provided by the plurality of digital microphones.

6. The microphone assembly of claim 5, wherein the microphone assembly further comprises a controller configured to control the positions of one or more of the plurality of digital microphones and wherein the processor is configured to send information about target positions via the serial digital communication interface to the controller for moving the one or more of the plurality of digital microphones to their respective target positions.

7. The microphone assembly of claim 1, wherein the processor of the digital signal processor is configured to compute a set of digital filters and to process the electrical signals provided by the plurality of digital microphones using the set of digital filters, wherein the set of digital filters can be adaptive and time-variant according to changes in an acoustical field, and/or changes of positions of the plurality of digital microphones.

8. The microphone assembly of claim 7, wherein the digital signal processor is configured to compute the set of digital filters on the basis of an approximate matrix inversion scheme, so as to generate one or more processed microphone signals with improved signal-to-noise ratio and better directivity pattern in comparison with raw microphone signals provided by the plurality of digital microphones.

9. A microphone assembly for acquiring a plurality of audio signals, the microphone assembly having a reconfigurable geometry so that the microphone assembly may be configured to be embedded in or attached to a body, the microphone assembly comprising:

a plurality of digital microphones configured to convert a sound signal impinging on each of the digital microphones into a corresponding digital electrical signal, wherein the digital electrical signal is a Pulse-Code-Modulation (PCM) or a Pulse-Density-Modulation (PDM) digital serial electrical signal;

a digital signal processor comprising a serial digital communication interface and a processor, wherein the serial digital communication interface is configured to receive the digital electrical signals provided by the plurality of digital microphones, and wherein the processor is configured to store, transmit, and/or process the digital electrical signals provided by the plurality of digital microphones; and a connecting and mounting structure configured to provide a flexible electrical connection and a flexible mechanical arrangement for the plurality of digital microphones, wherein the connecting and mounting structure comprises a plurality of wired connections configured to connect the plurality of digital microphones with the serial digital communication interface in such a way that at least one of the plurality of digital microphones is moveable relative to other digital microphones of the plurality of digital microphones, wherein the connecting and mounting structure comprises a plurality of enclosures, each enclosure encasing a rigid Printed Circuit Board (PCB), wherein one or more digital microphones of the plurality of digital microphones are soldered on the rigid PCB and connected to one of the plurality of wired connections.

10. The microphone assembly of claim 9, wherein the connecting and mounting structure comprises a plurality of fixing devices for fixing the plurality of enclosures on a surface of the rigid or flexible body where the microphone array is installed.

11. The microphone assembly of claim 10, wherein the plurality of fixing devices comprise one or more of: suction cups, clips, pins, zips, buttons, adhesive pads, crocodile jaws, and/or LEGO™ compatible "bricks".

12. A microphone assembly for acquiring a plurality of audio signals, the microphone assembly having a reconfigurable geometry so that the microphone assembly may be configured to be embedded in or attached to a body, the microphone assembly comprising:

a plurality of digital microphones configured to convert a sound signal impinging on each of the digital microphones into a corresponding digital electrical signal, wherein the digital electrical signal is a Pulse-Code-Modulation (PCM) or a Pulse-Density-Modulation (PDM) digital serial electrical signal;

a digital signal processor comprising a serial digital communication interface and a processor, wherein the serial digital communication interface is configured to receive the digital electrical signals provided by the plurality of digital microphones, and wherein the processor is configured to store, transmit, and/or process the digital electrical signals provided by the plurality of digital microphones; and a connecting and mounting structure configured to provide a flexible electrical connection and a flexible mechanical arrangement for the plurality of digital microphones, wherein the connecting and mounting structure comprises a plurality of wired connections configured to connect the plurality of digital microphones with the serial digital communication interface in such a way that at least one of the plurality of digital microphones is moveable relative to other digital microphones of the plurality of digital microphones, wherein the digital signal processor is configured to determine a position of at least one digital microphone of the plurality of digital microphones based on electrical signals provided by the plurality of digital microphones.

* * * * *